US007347143B2

(12) United States Patent
Shimizu

(10) Patent No.: US 7,347,143 B2
(45) Date of Patent: Mar. 25, 2008

(54) AIR BLOWING DEVICE FOR PRINTING PRESS

(75) Inventor: You Shimizu, Tokyo (JP)

(73) Assignee: Komori Corporation, Tokyo (JP)

( * ) Notice: Subject to any disclaimer, the term of this patent is extended or adjusted under 35 U.S.C. 154(b) by 184 days.

(21) Appl. No.: 11/406,025

(22) Filed: Apr. 17, 2006

(65) Prior Publication Data

US 2006/0236881 A1 Oct. 26, 2006

(30) Foreign Application Priority Data

Apr. 20, 2005 (JP) ..... 2005-122095

(51) Int. Cl.
*B41F 35/00* (2006.01)

(52) U.S. Cl. ..... 101/424.1; 101/419

(58) Field of Classification Search ..... None
See application file for complete search history.

(56) References Cited

U.S. PATENT DOCUMENTS 5,588,360 A * 12/1996 Kurz ..... 101/212
6,829,996 B2 * 12/2004 Jung et al. ..... 101/491
6,928,930 B1 * 8/2005 Gottling et al. ..... 101/424
6,983,696 B2 * 1/2006 Koch et al. ..... 101/487
7,055,430 B2 * 6/2006 Hesterman ..... 101/408
2005/0087086 A1 * 4/2005 Jung et al. ..... 101/424.1

FOREIGN PATENT DOCUMENTS

DE 4335097 A1 * 4/1995
JP 05-169633 A 7/1993
JP 2599074 U 7/1999

* cited by examiner

*Primary Examiner*—Anthony H. Nguyen
(74) *Attorney, Agent, or Firm*—Blakely, Sokoloff, Taylor & Zafman

(57) ABSTRACT

An air blowing device for a printing press includes a plate cylinder, blanket cylinder, impression cylinder, air blowing equipment, air suction equipment, and cover. The plate cylinder is rotatably supported. Ink from an inking device and dampening water from a dampening device are supplied to the outer surface of the plate cylinder. The blanket cylinder is rotatably supported in contact with the plate cylinder. The impression cylinder is rotatably supported in contact with the blanket cylinder and cooperates with the blanket cylinder to print on a printing target body under conveyance. The air blowing equipment discharges air from one end side toward the other end side of the blanket cylinder. The air suction equipment takes in air, discharged from the air blowing equipment, at the other end side of the blanket cylinder. The cover forms an air passage extending from the air blowing equipment to the air suction equipment in an axial direction of the blanket cylinder.

8 Claims, 4 Drawing Sheets

AIR BLOWING DEVICE FOR PRINTING PRESS

BACKGROUND OF THE INVENTION

The present invention relates to an air blowing device for a printing press, which vaporizes dampening water which has spread onto a blanket cylinder through a plate cylinder.

Generally, in an offset printing press, ink that is supplied to the plate surface of a printing plate mounted on a plate cylinder is once transferred to the blanket of a blanket cylinder and then to a printing sheet. At this time, dampening water is supplied in addition to the ink, so the ink attaches only to an image area and not to a non-image area. The dampening water spreads from the plate surface onto the blanket surface and then to the printing sheet sequentially. The printing sheet that has absorbed moisture tends to elongate horizontally and vertically. Particularly, in the case of multi-color printing, each time the printing sheet passes through a printing unit, the printing sheet absorbs moisture and elongates. Hence, a pattern that is printed earlier elongates more to be larger than the original size. Consequently, patterns that should overlap are printed with registration errors to lower the registration accuracy, causing a so-called fan-out phenomenon.

The fan-out phenomenon becomes typical to cause a major printing trouble in a double-sided printing press which prints the obverse and reverse sides of a printing sheet simultaneously, because the moisture to be absorbed doubles. As a countermeasure against the fan-out phenomenon, a method has been proposed which blows air to the outer surface of the cylinder to vaporize the moisture.

Conventionally, as shown in Utility Model Registration No. 2599074, fans which blow air to the outer surface of an ink oscillating roller are arranged on the rear side of a cover that opens/closes the front side of a printing unit. Another arrangement has also been proposed in which air is blown from a plurality of air pipes to the outer surface of a roller which forms an inking device, as shown in Japanese Patent Laid-Open No. 5-169633.

In each of the conventional air blowing devices described above, air is blown in the radial direction of the roller. The air blown to the surface of the roller flows in even to behind the roller to flutter the printing sheet under conveyance or cause a gripping change error of the printing sheet, leading to jamming or a trouble of the printing press. Also, the air that has flown in even to behind the roller to reach the plate cylinder may vaporize the originally necessary moisture on the plate cylinder to degrade the printing quality.

In the latter air blowing device, a plurality of air pipes 43 which blow air toward a blanket cylinder 42 in contact with a plate cylinder 40 and impression cylinder 41, as shown in FIG. 5A, are arranged equidistantly in the axial direction (a direction of arrows A-B) of the blanket cylinder 42, as shown in FIG. 5B. Therefore, portions that are strongly blown with air by the air pipes 43 and portions that are scarcely blown alternate in the axial direction of the blanket cylinder 42. A larger amount of moisture evaporates from the portions that are strongly blown with air. This causes striped density nonuniformities on the printing surface of a printing sheet 44 to degrade the printing quality.

SUMMARY OF THE INVENTION

It is an object of the present invention to provide an air blowing device for a printing press, which prevents a printing trouble and improves the printing quality simultaneously.

In order to achieve the above object, according to the present invention, there is provided an air blowing device for a printing press, comprising a plate cylinder which is rotatably supported and to an outer surface of which ink from an inking device and dampening water from a dampening device are supplied, a blanket cylinder which is rotatably supported in contact with the plate cylinder, a printing cylinder which is rotatably supported in contact with the blanket cylinder and cooperates with the blanket cylinder to print on a printing target body under conveyance, air blowing means for discharging air from one end side toward the other end side of the blanket cylinder, air suction means for taking in air, discharged from the air blowing means, at the other end side of the blanket cylinder, and air passage forming means for forming an air passage extending from the air blowing means to the air suction means in an axial direction of the blanket cylinder.

DESCRIPTION OF THE PREFERRED EMBODIMENTS

Figure 1:
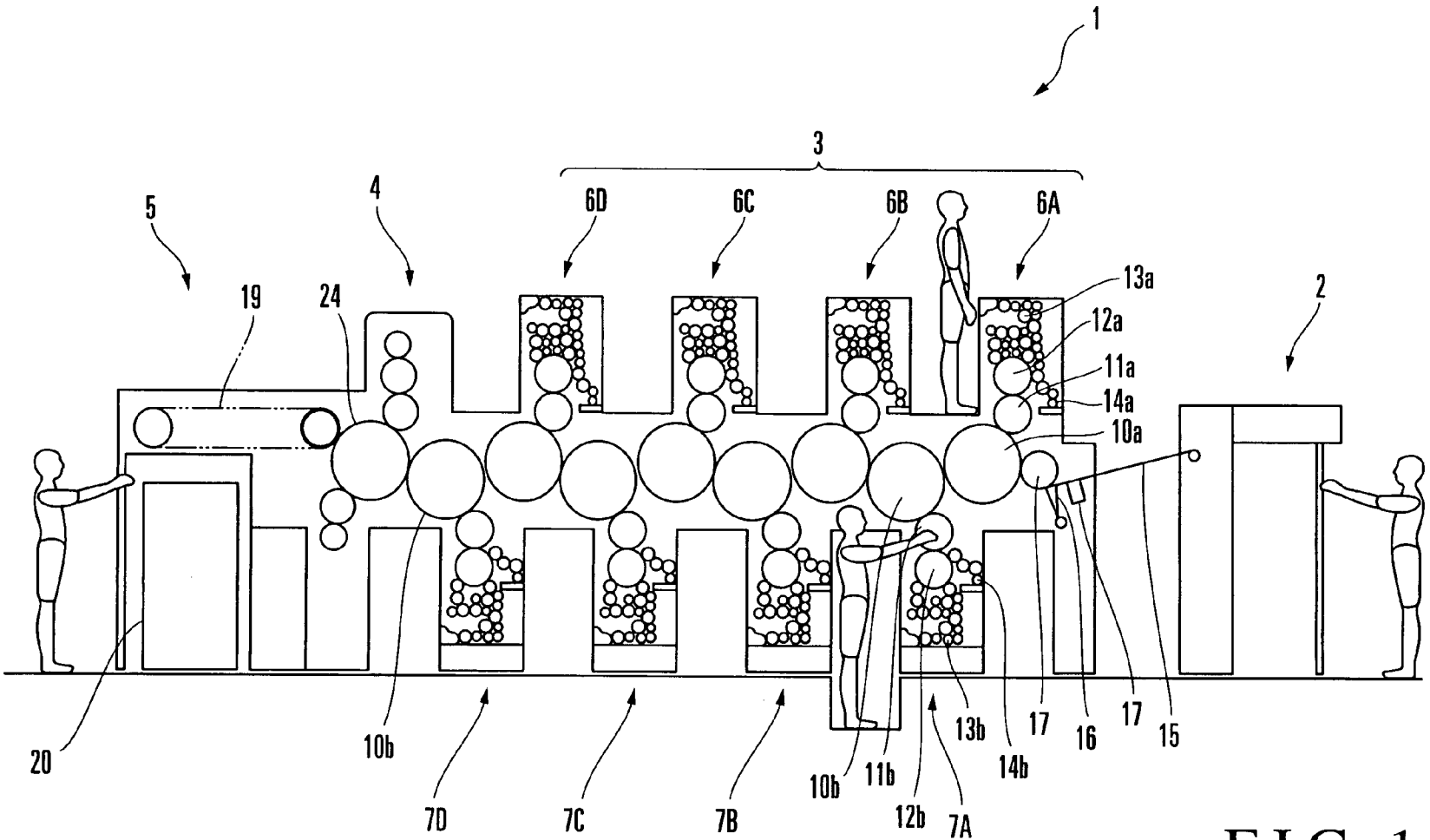
FIG. 1 is a side view showing the schematic arrangement of a double-sided rotary printing press to which the present invention is applied.

An air blowing device for a printing press according to one embodiment of the present invention will be described with reference to FIGS. 1 to 4. Referring to FIG. 1, a sheet-fed offset rotary printing press 1 comprises a feed device 2 which feeds a sheet for printing, a printing unit 3 which prints on the sheet fed from the feed device 2, a coating unit 4 which coats the obverse and reverse surfaces of the sheet printed by the printing unit 3 with varnish, and a delivery unit 5 which delivers the sheet coated by the coating unit 4. The printing unit 3 comprises four obverse surface printing units 6A to 6D which print on the obverse surface of the sheet, and four reverse surface printing units 7A to 7D which print on the reverse surface of the sheet.

Each of the obverse surface printing units 6A to 6D includes an impression cylinder 10*a* serving as a double-sized diameter printing cylinder which has grippers on its outer surface to grip the sheet, a blanket cylinder 11*a* which is located on the impression cylinder 10*a* to be in contact with it, a plate cylinder 12*a* which is located on the blanket cylinder 11*a* to be in contact with it, an inking device 13*a* which supplies ink to the plate cylinder 12*a*, and a dampening device 14*a* which supplies dampening water to the plate cylinder 12*a*.

Each of the reverse surface printing units 7A to 7D includes an impression cylinder 10*b* serving as a double-sized diameter printing cylinder which has grippers on its outer surface to grip the sheet, a blanket cylinder 11*b* which is located under the impression cylinder 10*b* to be in contact with it, a plate cylinder 12*b* which is located under the blanket cylinder 11*b* to be in contact with it, an inking device 13*b* which supplies ink to the plate cylinder 12*b*, and a dampening device 14*b* which supplies dampening water to the plate cylinder 12*b*.

In this arrangement, the leading edge of the sheet fed from the feed device 2 onto a feeder board 15 is gripped by a swing arm shaft pregripper 16 and conveyed to the obverse surface printing unit 6A through a transfer cylinder 17. The sheet conveyed to the obverse surface printing unit 6A is gripping-changed to the grippers of the impression cylinder 10*a* and printed with the first color on its obverse surface as it passes through the opposing point of the impression cylinder 10*a* and blanket cylinder 11*a*. Subsequently, the sheet printed with the first color on its obverse surface is gripping-changed to the impression cylinder 10*b* of the reverse surface printing unit 7A and printed with the first color on its reverse surface as it passes through the opposing point of the impression cylinder 10*b* and blanket cylinder 11*b*.

The sheet is subsequently printed with the second to fourth colors on its obverse and reverse surfaces by the obverse surface printing units 6B to 6D and reverse surface printing units 7B to 7D, and is coated with varnish on its obverse and reverse surfaces by the coating unit 4. The vanish-coated sheet is gripping-changed to the delivery grippers (not shown) of a delivery chain 19 of the delivery unit 5, is conveyed by the delivery chain 19, and falls on a delivery pile 20 and is stacked there.

Figure 2:
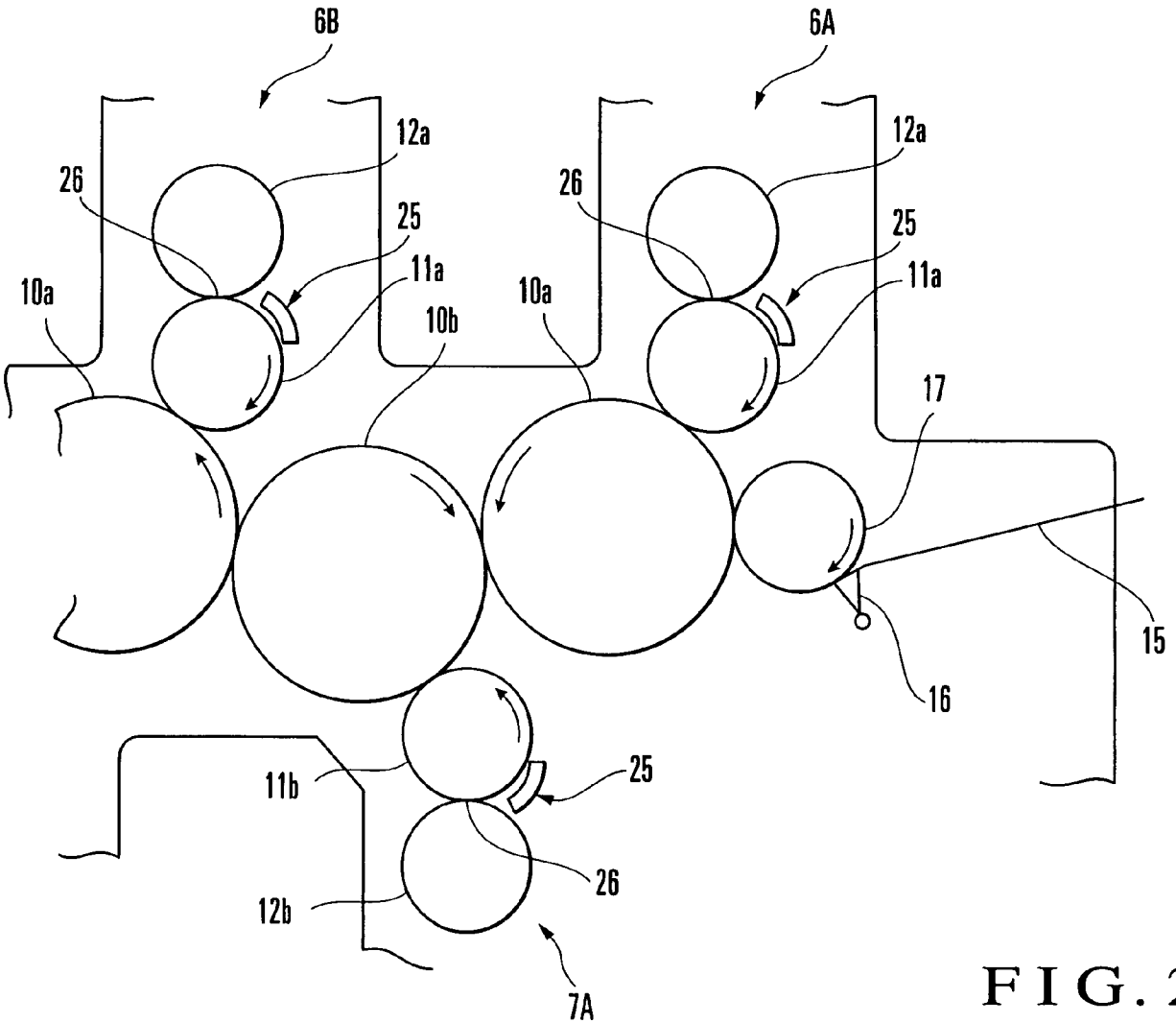
FIG. 2 is an enlarged side view of the main part of the double-sided rotary printing press shown in FIG. 1.

The air blowing device will now be described with reference to FIGS. 2 to 4B. As shown in FIG. 2, air blowing devices 25 are arranged to oppose the outer surfaces of the blanket cylinders 11*a* and 11*b* in the respective printing units. Each air blowing device 25 is arranged downstream of an opposing point 26 of the blanket cylinder 11*a* or 11*b* and the corresponding plate cylinder 12*a* or 12*b* in the rotational direction of the blanket cylinder 11*a* or 11*b*. The air blowing device 25 blows air from the plate cylinder 12*a* or 12*b* to a blanket 27 of the corresponding blanket cylinder 11*a* or 11*b* to vaporize the dampening water that has spread onto the blanket 27. Thus, the dampening water will not spread onto the printing sheet conveyed by the impression cylinder 10*a* or 10*b*, thus preventing fan-out.

Figure 3:
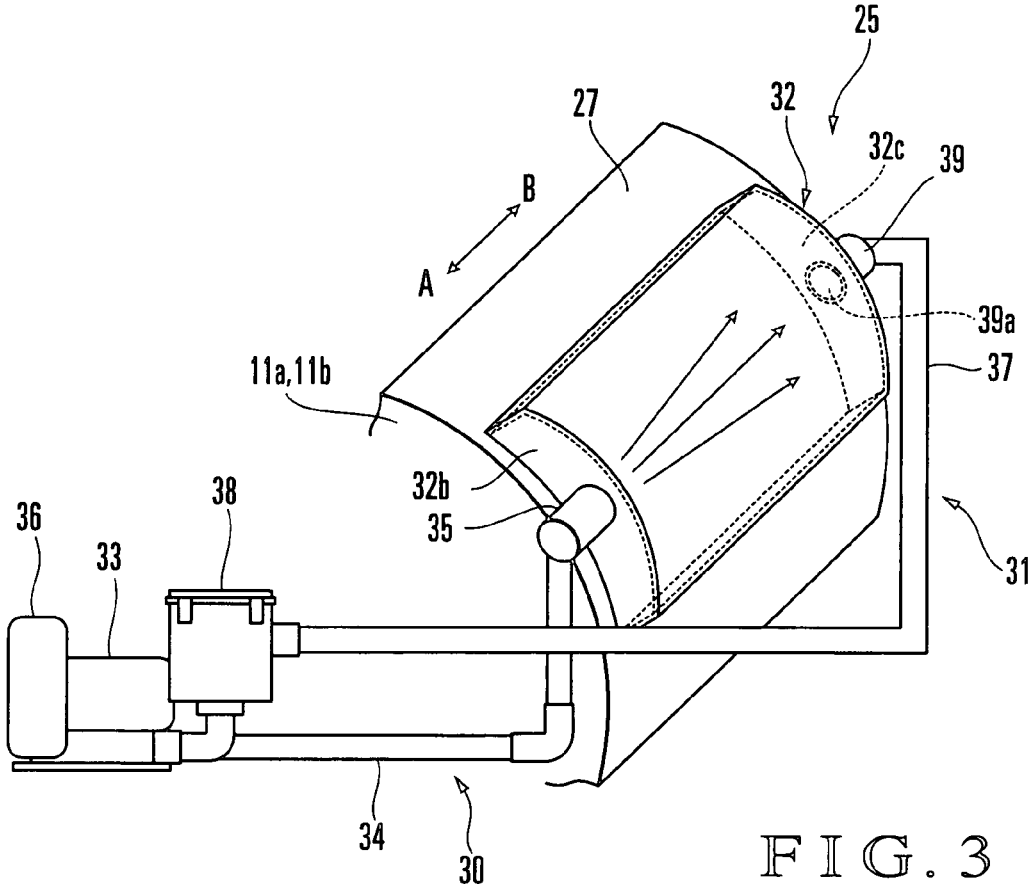
FIG. 3 is a perspective view of the main part of the air blowing device shown in FIG. 2.

As shown in FIG. 3, the air blowing device 25 comprises an air blowing equipment 30 which flows air to the blanket 27 of the blanket cylinder 11*a* or 11*b*, an air suction equipment 31 which takes in air discharged from the air blowing equipment 30, and a box-like cover 32 which forms a passage for air (guides air) discharged from the air blowing equipment 30. The air blowing equipment 30 includes a discharge pump 33 which supplies discharge air, and an air blowing cylinder 35 which is connected to the discharge pump 33 through a pipe 34. The air suction equipment 31 includes a suction pump 36 which supplies suction air, and an air suction cylinder 39 which is connected to the suction pump 36 through a pipe 37 and air filter 38. The cover 32 is entirely curved to conform to the outer surface of the blanket cylinder 11*a* or 11*b*.

Figure 4A:
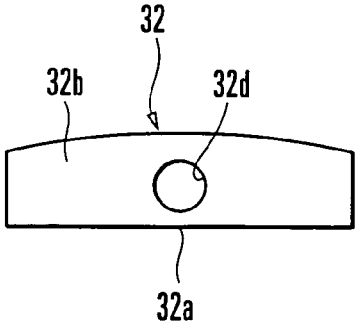
FIGS. 4A and 4B are a side view and cross-sectional view, respectively, of the cover shown in FIG. 3.
Figure 4B:
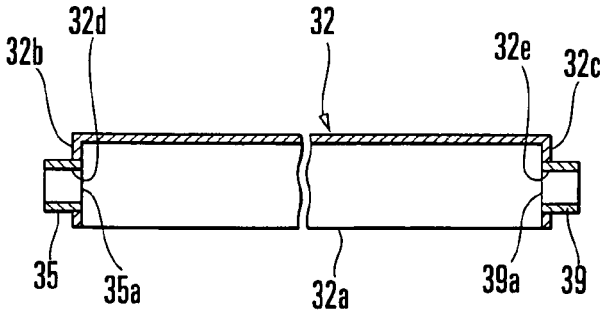
Figure 5A:
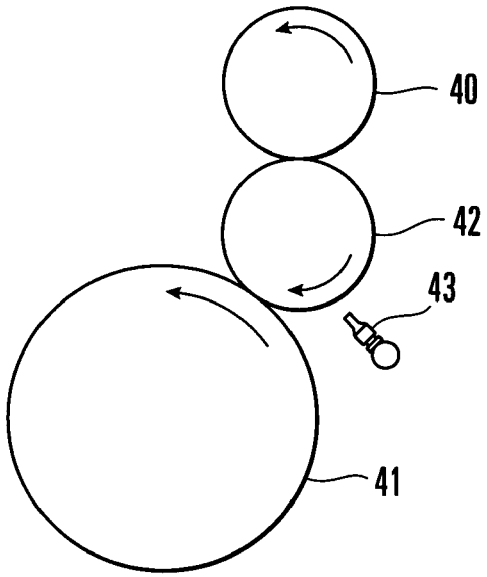
FIG.5A PRIOR ART
FIG. 5A is a view for describing a conventional air blowing device for a printing press.
Figure 5B:
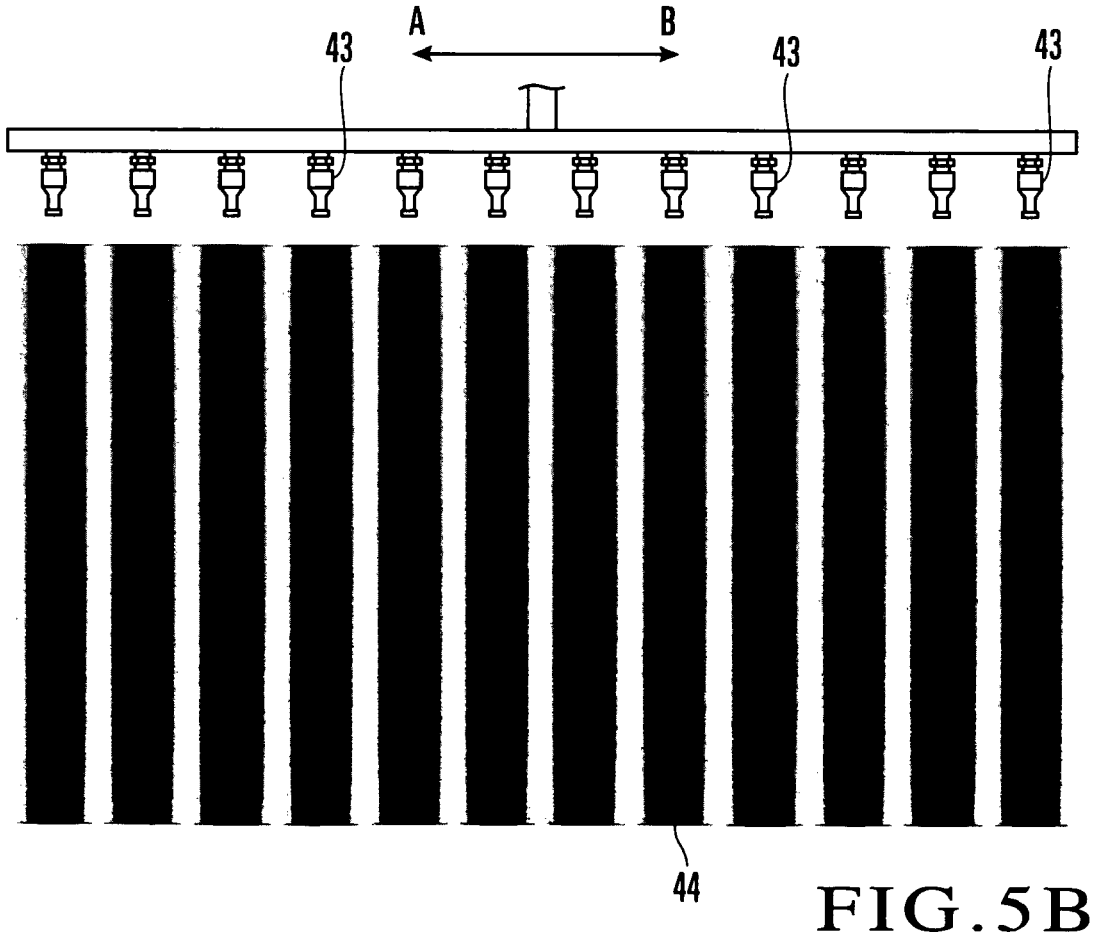
FIG.5B PRIOR ART
FIG. 5B is a view showing the ink densities of the printed surface which is printed by the printing press shown in FIG. 5A.

As shown in FIGS. 4A and 4B, the cover 32 serving as the air passage forming means has an opening 32*a* to oppose the outer surface of the blanket cylinder 11*a* or 11*b*, and attaching holes 32*d* and 32*e* in its side surfaces 32*b* and 32*c* which oppose each other in the axial direction of the blanket cylinder 11*a* or 11*b*. The gap between the two side surfaces 32*b* and 32*c* of the cover 32 has substantially the same length as the cylinder length of the blanket cylinder 11*a* or 11*b*. The two side surfaces 32*b* and 32*c* are respectively positioned at the two ends of the blanket cylinder 11*a* or 11*b*. Hence, the cover 32 completely covers part of the outer surface of the blanket cylinder 11*a* or 11*b* in the axial direction, and the opening 32*a* opposes the outer surface of the blanket cylinder 11*a* or 11*b*, so the inside of the cover 32 is substantially hermetically sealed.

The cylinder 35 has an air blowing port 35*a* to discharge air. The air blowing port 35*a* is attached to the attaching hole 32*d* to face the inside of the cover 32. The cylinder 39 has an air suction port 39*a* to take in air. The air suction port 39*a* is attached to the attaching hole 32*e* to oppose the air blowing port 35*a* so as to face the inside of the cover 32. Thus, the air blowing port 35*a* and air suction port 39*a* are located in the vicinities of the outer surface at the two ends of the blanket cylinder 11*a* or 11*b*.

Air discharged from the air blowing port 35*a* flows through the cylinder 35 from one end to the other end of the blanket cylinder 11*a* or 11*b* along the outer surface of the blanket cylinder 11*a* or 11*b*, and is exhausted from the air suction port 39*a*. In other words, the air discharged from the air blowing port 35*a* blows the blanket 27 mounted on the outer surface of the blanket cylinder 11*a* or 11*b* in the axial direction (a direction of an arrow B) of the blanket cylinder 11*a* or 11*b*.

In this arrangement, air is supplied from the discharge pump 33 to the cylinder 35 through the pipe 34, and taken in by the suction pump 36 from the cylinder 39 through the pipe 37 and air filter 38. Air supplied from the discharge pump 33 blows the blanket 27 mounted on the outer surface of the blanket cylinder 11*a* or 11*b* from the air blowing port 35*a* of the cylinder 35. At this time, the air blowing direction is parallel to the axial direction of the blanket cylinder 11*a* or 11*b* and perpendicular to the rotational direction of the blanket cylinder 11*a* or 11*b*. Hence, as the blanket cylinder 11*a* or 11*b* rotates, air blows the entire outer surface of the blanket cylinder 11*a* or 11*b* evenly. As a result, the dampening water that has spread onto the blanket 27 of the blanket cylinder 11*a* or 11*b* vaporizes evenly without any nonuniformities, and the ink printed on the printing sheet does not cause density nonuniformities, so that the printing quality can improve.

Because the air to be discharged from the air blowing port 35*a* is not discharged in the radial direction of the blanket cylinder 11*a* or 11*b*, the air does not flow into the machine. Thus, printing troubles such as jamming or a trouble of the printing press which are caused by flutter of the printing sheet under conveyance or a gripping change error of the printing sheet can be prevented. Also, the originally necessary moisture on the plate cylinder 12*a* or 12*b* will not be vaporized, so the printing quality can improve.

Because the air discharged from the air blowing port 35*a* is supplied from the air suction port 39*a* which opposes the air blowing port 35*a*, the air discharged from the air blowing port 35*a* is taken in by the air suction port 39*a* without diffusing inside the cover 32. Thus, the dampening water that has spread onto the blanket 27 of the blanket cylinder 11*a* or 11*b* can vaporize efficiently. Printing nonuniformities do not occur regardless of the air discharge amount from the air blowing port 35*a*. Thus, by increasing the air blowing amount, the moisture is vaporized efficiently to reliably prevent fan-out. The air taken in from the air suction port 39*a* is emitted to the atmosphere by the suction pump 36 through the pipe 37 and air filter 38, together with the dampening water which has vaporized from the blanket 27.

Because of the presence of the cover 32 which covers the outer surface of the blanket cylinder 11*a* or 11*b* substantially in a hermetically sealed state, even when the air blowing force increases, the air can be reliably regulated from flowing into the machine. Thus, the dampening water that has spread onto the blanket 27 of the blanket cylinder 11*a* or 11 can vaporize efficiently. As the cover 32 can further regulate diffusion of the air discharged from the air blowing port 35*a*, the dampening water that has spread onto the blanket 27 of the blanket cylinder 11*a* or 11*b* can vaporize evenly and efficiently. As a result, the ink printed on the printing surface of the printing sheet does not cause density nonuniformities, so the printing quality can improve.

Although the above embodiment has been exemplified by a double-sided printing press, the present invention can naturally be applied to a single-sided printing press as well. Although the printing cylinder is an impression cylinder that is in contact with the blanket cylinder, the present invention can also be applied to a double-sided printing press which prints on the two surfaces of a sheet passing through impression cylinders that are in contact with each other. Although a case of printing on a sheet has been described, the present invention can also be applied to a web rotary printing press which prints on an elongated web.

As has been described above, according to the present invention, air discharged from an air blowing means blows in a direction parallel to the axial direction of the blanket cylinder, that is, in a direction perpendicular to the rotational direction of the blanket cylinder. As the blanket cylinder rotates, the air blows the entire outer surface of the blanket cylinder evenly. Thus, the dampening water that has spread onto the blanket of the blanket cylinder vaporizes evenly without nonuniformities. Ink density nonuniformities do not occur on the printing surface, so the printing quality improves.

What is claimed is:

1. An air blowing device for a printing press, comprising:

a plate cylinder which is rotatably supported and to an outer surface of which ink from an inking device and dampening water from a dampening device are supplied;

a blanket cylinder which is rotatably supported in contact with said plate cylinder;

a printing cylinder which is rotatably supported in contact with said blanket cylinder and cooperates with said blanket cylinder to print on a printing target body under conveyance;

air blowing means for discharging air from one end side toward the other end side of said blanket cylinder;

air suction means for taking in air, discharged from said air blowing means, at the other end side of said blanket cylinder; and air passage forming means for forming an air passage extending from said air blowing means to said air suction means in an axial direction of said blanket cylinder.

2. A device according to claim 1, wherein said air passage forming means comprises a cover that covers part of an outer surface of said blanket cylinder in the axial direction of said blanket cylinder.

3. A device according to claim 2, wherein said cover comprises a box including an opening arranged to oppose said outer surface of said blanket cylinder, an air blowing port which is attached to one side surface corresponding to one end of said blanket cylinder and discharges air into a space between said outer surface of said blanket cylinder and said cover, and an air suction port which is attached to the other side surface corresponding to the other end of said blanket cylinder to oppose said air blowing port and takes in air from the space between said outer surface of said blanket cylinder and said cover.

4. A device according to claim 3, further comprising:

an air blowing equipment comprising an air blowing cylinder which includes said air blowing port; and an air suction equipment comprising an air suction cylinder which includes said air suction port.

5. A device according to claim 3, wherein said box forms an entirely curved shape to conform to said outer surface of said blanket cylinder.

6. A device according to claim 1, wherein air discharged from said air blowing means blows said outer surface of said blanket cylinder by an air passage formed by said air passage forming means.

7. A device according to claim 1, wherein said printing cylinder comprises an impression cylinder.

8. A device according to claim 7, comprising a first printing unit which includes said plate cylinder, said blanket cylinder, said impression cylinder, said air blowing means, said air suction means, and said air passage forming means and prints on an obverse surface of a printing target body, and a second printing unit which includes said plate cylinder, said blanket cylinder, said impression cylinder, said air blowing means, said air suction means, and said air passage forming means and prints on a reverse obverse surface of the printing target body, wherein an outer surface of said impression cylinder of said first printing unit and an outer surface of said impression cylinder of said second printing unit are in contact with each other.

* * * * *